US011209208B2

(12) United States Patent
Rehage et al.

(10) Patent No.: US 11,209,208 B2
(45) Date of Patent: Dec. 28, 2021

(54) STORAGE SHELF BASE AND ITEM OF FURNITURE OR HOUSEHOLD APPLIANCE

(71) Applicant: PAUL HETTICH GMBH & CO. KG, Kirchlengern (DE)

(72) Inventors: Daniel Rehage, Chemnitz (DE); Stefan Mertins, Bünde (DE); Eduard Arnst, Lemgo (DE); Andreas Matthes, Chemnitz (DE)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 66 days.

(21) Appl. No.: 16/641,836

(22) PCT Filed: Aug. 27, 2018

(86) PCT No.: PCT/EP2018/072991
§ 371 (c)(1),
(2) Date: Feb. 25, 2020

(87) PCT Pub. No.: WO2019/042921
PCT Pub. Date: Mar. 7, 2019

(65) Prior Publication Data

US 2021/0164726 A1 Jun. 3, 2021

(30) Foreign Application Priority Data

Sep. 1, 2017 (DE) ..... 10 2017 120 158.0
Apr. 16, 2018 (DE) ..... 10 2018 108 978.3

(51) Int. Cl.
*F25D 25/02* (2006.01)
*A47B 49/00* (2006.01)
*A47B 96/02* (2006.01)

(52) U.S. Cl.
CPC ..... *F25D 25/027* (2013.01); *A47B 49/004* (2013.01); *A47B 96/025* (2013.01); *A47B 49/006* (2013.01); *F25D 2325/021* (2013.01)

(58) Field of Classification Search
CPC ..... F25D 25/027; F25D 2325/021; A47B 49/004; A47B 96/025; A47B 49/006
See application file for complete search history.

(56) References Cited

U.S. PATENT DOCUMENTS 535,886 A * 3/1895 Brand ..... F04D 25/08 5/173
1,941,906 A * 1/1934 Marinsky ..... F25D 25/027 312/305

(Continued)

FOREIGN PATENT DOCUMENTS

DE 4216765 A1 12/1992
DE 102017106170 A1 9/2018

(Continued)

OTHER PUBLICATIONS

International Search Report dated Sep. 24, 2018 in related/corresponding International Application No. PCT/EP2018/072991.

(Continued)

*Primary Examiner* — Hanh V Tran
(74) *Attorney, Agent, or Firm* — Patent Portfolio Builders PLLC

(57) ABSTRACT

A storage shelf base for an item of furniture or household appliance includes a support plate stationarily arranged on a body of the item of furniture or household appliance, and a storage shelf positively driven relative to the support plate and can simultaneously be moved rotationally and translationally. Facing bearing surfaces of the support plate and the storage shelf have respective at least substantially closed circulating running grooves, in which rolling elements are guided. The support plate can be detachably secured to the (Continued)

Figure 1:
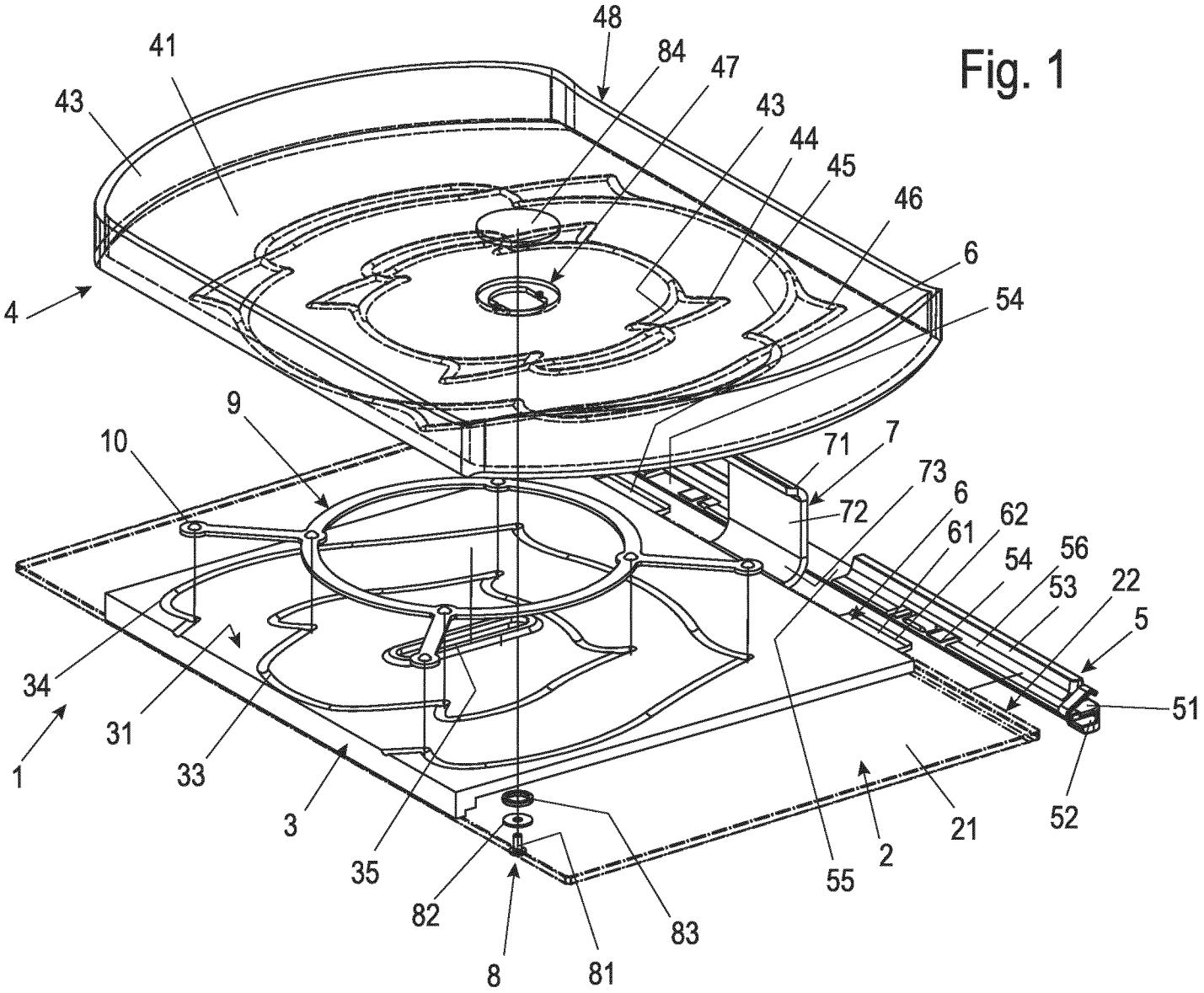

body of the item of furniture or household appliance by an adapter or a base plate is stationarily arranged on the body of the item of furniture or household appliance, on which the support plate is detachably secured.

13 Claims, 12 Drawing Sheets

(56) References Cited

U.S. PATENT DOCUMENTS 2,316,408 A * 4/1943 Dawson ..... F16H 25/14 74/55
2,540,125 A * 2/1951 Kolks ..... F16C 29/04 74/55
2,647,812 A * 8/1953 Saunders ..... F25D 25/027 312/294
2,840,438 A * 6/1958 Sharpe ..... F25D 25/027 312/322
2,936,205 A * 5/1960 Clark ..... F25D 25/027 312/302
3,107,959 A * 10/1963 Maxwell, Jr. ..... F25D 25/02 312/322
4,124,262 A * 11/1978 Schill ..... A47B 49/004 16/378
4,191,437 A * 3/1980 Funke ..... A47B 49/00 108/94
4,392,628 A * 7/1983 Hadfield ..... A47B 49/004 211/144
4,485,997 A * 12/1984 Potter ..... A47B 49/00 211/163
4,582,372 A * 4/1986 Cooper ..... A47B 46/00 108/140
6,322,679 B1 * 11/2001 De Bosscher ..... H01J 37/3408 204/192.12
6,585,119 B2 * 7/2003 Palder ..... A47F 5/02 211/163
7,147,445 B2 * 12/2006 Krayer ..... F16N 13/20 418/150
9,022,495 B1 * 5/2015 Conner, Sr. ..... F25D 25/027 312/408
9,052,134 B1 * 6/2015 Batchler ..... F25D 25/02
9,528,753 B1 * 12/2016 Conner, Sr. ..... A47F 3/08
2002/0117943 A1 * 8/2002 Gerkey ..... A47B 49/006 312/238
2005/0196310 A1 * 9/2005 Krayer ..... A47B 81/002 418/61.3
2014/0300266 A1 * 10/2014 Rindlisbach ..... F25D 23/067 312/408
2017/0184335 A1 * 6/2017 Jeon ..... F25D 23/04
2020/0018349 A1 1/2020 Rehage et al.
2020/0170408 A1 * 6/2020 Rehage ..... A47B 81/002
2020/0187641 A1 * 6/2020 Rehage ..... F25D 25/027
2020/0191471 A1 * 6/2020 Rehage ..... A47B 49/004

FOREIGN PATENT DOCUMENTS

EP 3159635 A1 4/2017
WO 2010063552 A2 6/2010

OTHER PUBLICATIONS

Search Report dated Apr. 2, 2019 in related/corresponding DE Application No. 10 2018 108 978.3.
Written Opinion dated Sep. 24, 2018 in related/corresponding International Application No. PCT/EP2018/072991.

* cited by examiner

STORAGE SHELF BASE AND ITEM OF FURNITURE OR HOUSEHOLD APPLIANCE

BACKGROUND AND SUMMARY OF THE INVENTION

Exemplary embodiments of the present invention relate to a storage shelf base for an item of furniture or household appliance and an item of furniture or household appliance.

Storage shelf bases of this type, in which a support plate and a storage shelf guided on the support plate are arranged on a base plate and can be moved simultaneously in rotation and translation, allow access to otherwise inaccessible surfaces in the storage space of an item of furniture or household appliance such as a refrigerator or freezer.

For example, DE 42 16 765 A1 discloses storage shelf bases equipped with a turntable where the turntable is installed directly in the base plate of the storage shelf base.

The post-published DE 10 2017 106 170 A1 discloses a storage shelf that is positively guided relative to the support plate and can be moved simultaneously in rotation and translation.

A disadvantage of these storage shelf bases is the relatively complex assembly of such a storage shelf base.

Exemplary embodiments of the present invention are directed to a storage shelf base for an item of furniture or household appliance that can be easily integrated into a body of the item of furniture or household appliance or retrofitted in a simple manner.

The storage shelf base has a support plate and, furthermore, a storage shelf that is positively guided relative to the support plate and can be moved simultaneously by rotation and translation, wherein the bearing surfaces of the support plate and the shelf facing one another have respective at least predominantly closed, circumferential running grooves in which rolling elements are guided.

The support plate is detachably attached to a base plate or detachably attached to the body of the furniture or household appliance by means of at least one adapter.

This makes it easy to attach the storage shelf that is movable rotationally and translationally to the body of the furniture or household appliance.

In one embodiment variant, the storage shelf base comprises a base plate that can be fixed in a stationary manner to the body of the furniture or household appliance. The support plate is preferably arranged on this base plate.

Preferably, the storage shelf base has a base plate and the adapter is designed as a base plate holder, which fixes the base plate to the body of the furniture or household appliance.

In accordance with an advantageous embodiment variant of the storage shelf base, the base plate holder at least partially embraces an edge of the base plate and has at least one first recess in which a connecting element extending from one edge of the support plate can be inserted, which connecting element, in the inserted state, is held positively or frictionally in the base plate holder.

Such base plate holders are often used, for example, for base plates designed as glass plates to fix the base plate to the body of the furniture or household appliance.

The insertion of corresponding recesses in this base plate holder is extremely easy, so that by slightly modifying the base plate holder, the support plate can be mounted for supporting the storage shelf.

The connecting element is preferably integrally formed on the support plate. It is also conceivable to manufacture such a connecting element as a separate component and attach it to the support plate.

The connecting element is designed as a hook in accordance with an advantageous embodiment variant, which engages behind a strip section of the base plate holder, which enables extremely simple mounting of the support plate to the base plate holder.

According to a further embodiment variant, the support plate has retaining elements engaging around the base plate.

Such a solution is particularly advantageous if the base plate holder is not available or is not suitable for holding the support plate.

Here, too, the retaining elements are preferably integrally formed on the support plate. It is also conceivable here to provide such retaining elements as separate components that are fastened to the support plate.

In accordance with an alternative embodiment variant, the base plate holder at least partially engages around one edge of the base plate. The support plate and the base plate holder have form-fit elements that allow the support plate to be fixed in a form-fitting manner to the base plate holder by a pivoting movement from a position of the support plate at an angle to the base plate to a position of the support plate resting on the base plate.

This allows the support plate to be mounted to the base plate holder and placed on the base plate by means of a simple pivoting movement.

For this purpose, recesses are preferably formed on the rear edge of the support plate facing the base plate holder, into which a hook element integrally formed on the base plate holder engages.

Such recesses and hook elements can be easily formed on the base plate holder or the base plate.

In order to also reliably prevent linear slippage of the storage shelf relative to the base plate, at least one recess is integrally formed in accordance with a further preferred embodiment in an underside of the support plate facing the base plate near the edge facing the base plate holder, into which recess, when the support plate is pivoted onto the support plate, a counter strip formed on the base plate holder protrudes.

For exact, especially central positioning of the storage shelf on the base plate, also transverse to the translation movement of the storage shelf, the contact surfaces of the respective side edges of the support plate lie close to the rear edge of the support plate on the respective stop surfaces of stops protruding from the base plate holder towards the support plate.

Due to the connection according to the invention, the support plate is detachably fixed and secured in position both vertically and horizontally. Unintentional loosening of the support plate or tilting forwards or slipping to the side are prevented.

According to a further advantageous embodiment variant of the invention, a tilting protection element is arranged on the support plate, the tilting protection element overlapping the upper edge of the shelf and serving to prevent a tilting movement of the storage shelf around a tilting axis parallel to the shelf surface. Alternatively, the tilting protection element can be designed in such a way that it engages in a groove in the storage shelf.

The advantage of such a tilting protection element is the prevention of a tilting movement of the storage shelf, especially when the load on the storage shelf is unevenly distributed with objects placed on the storage shelf.

According to a preferred embodiment variant, a section of the tilting protection element is located in a second recess of the base plate holder, whereby additional stabilization of the tilting protection element is achieved. The tilting protection element is designed as a catch hook according to a preferred embodiment variant, in particular as a C-shaped catch hook.

The storage shelf base according to the invention can preferably be used in an item of furniture or in a household appliance, especially in a refrigerator or freezer. In addition, the item of furniture or household appliance each has a body for accommodating the storage shelf base.

BRIEF DESCRIPTION OF THE DRAWING FIGURES

Figure 2:
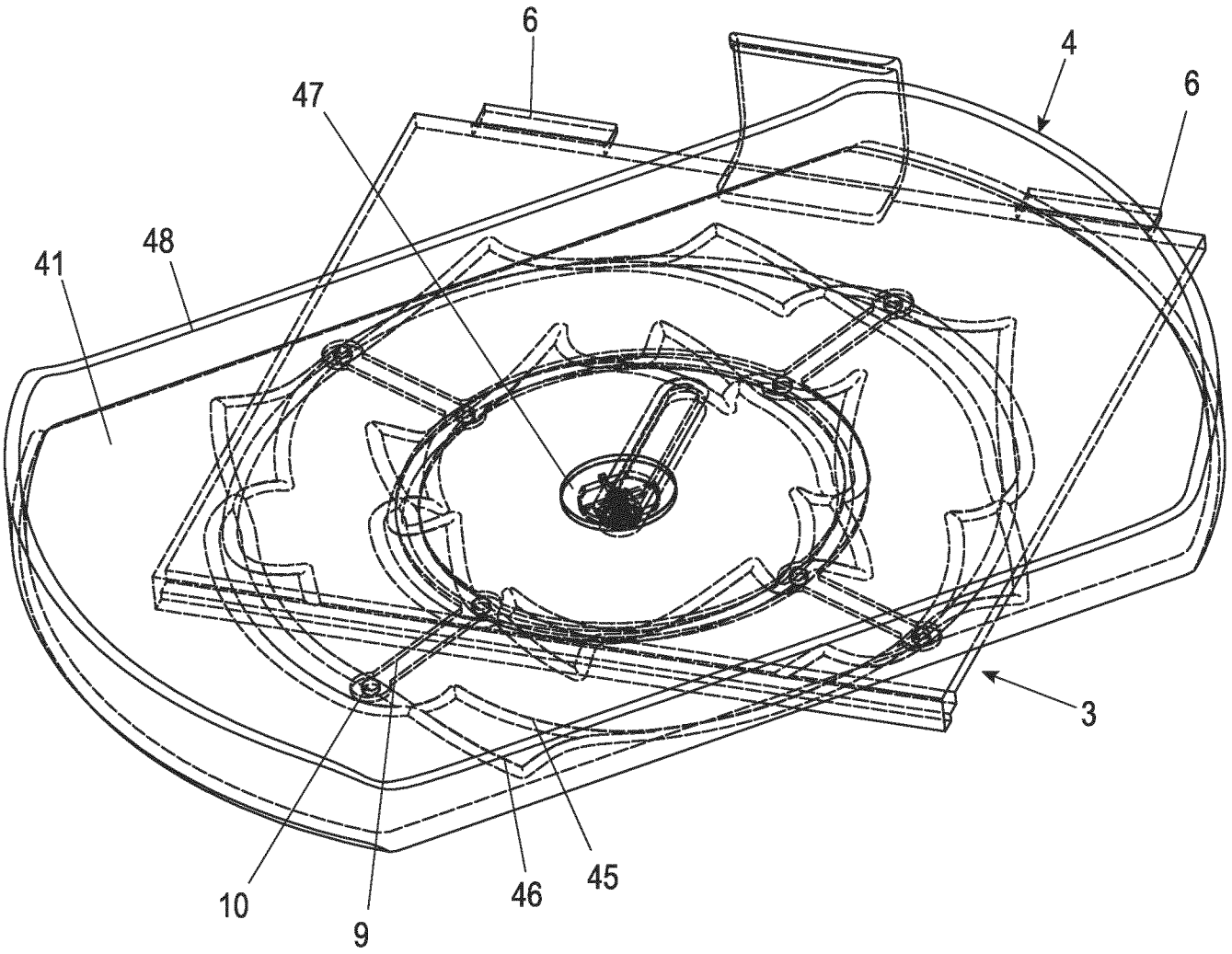
Figure 3:
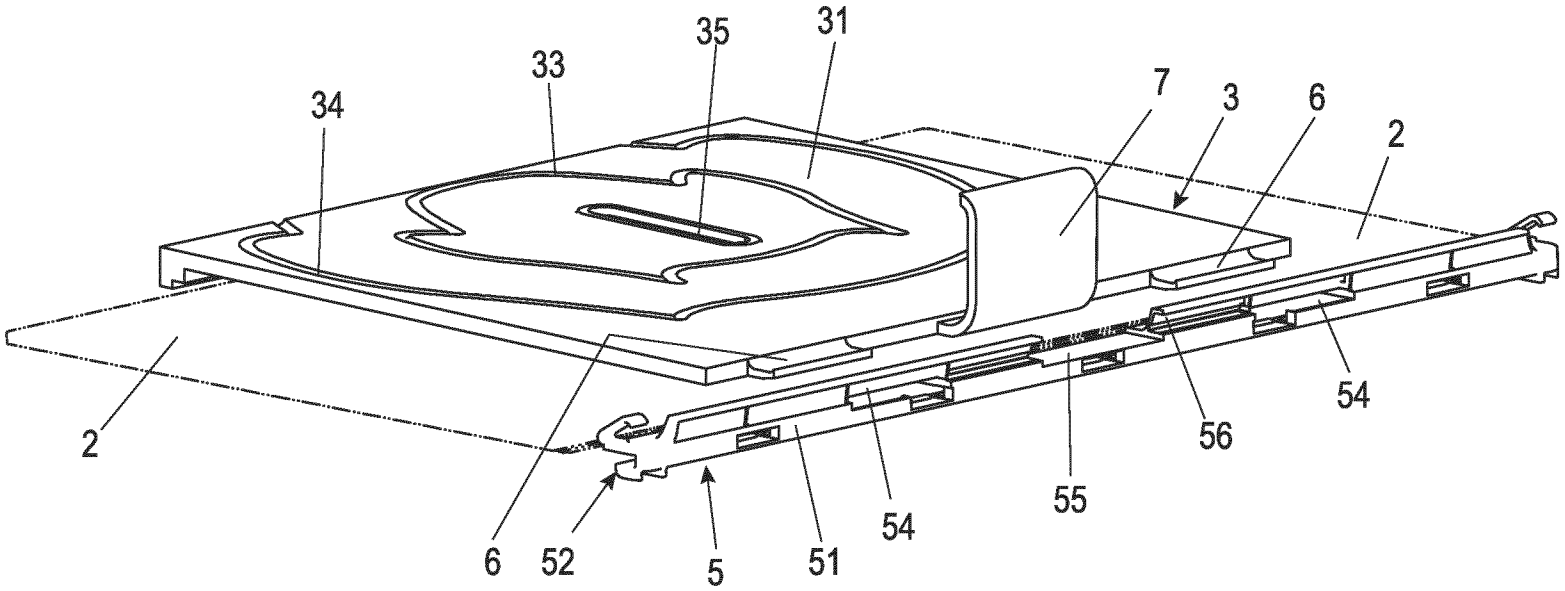
Figure 4:
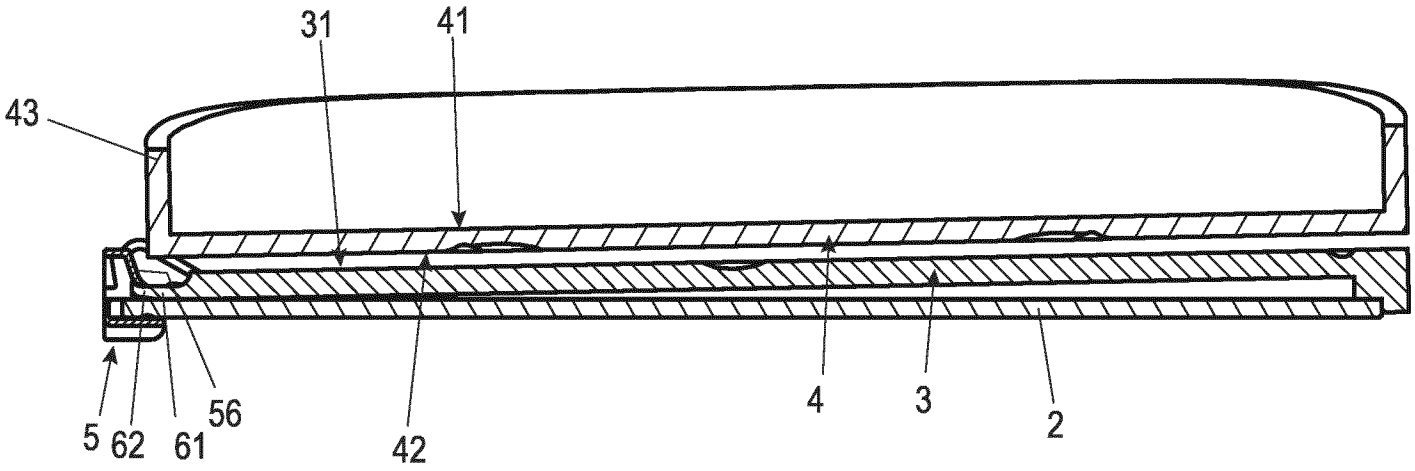
Figure 5:
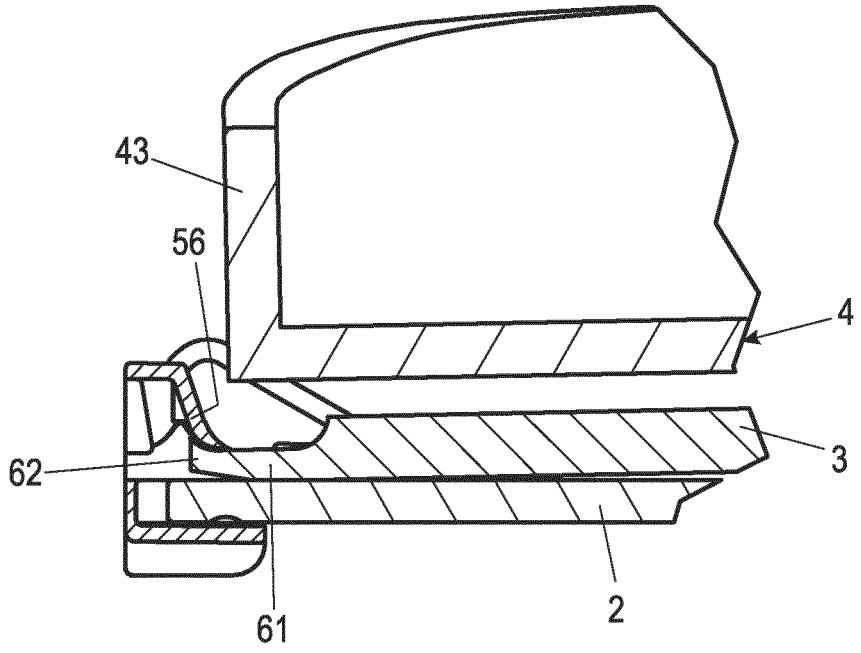
Figure 6A:
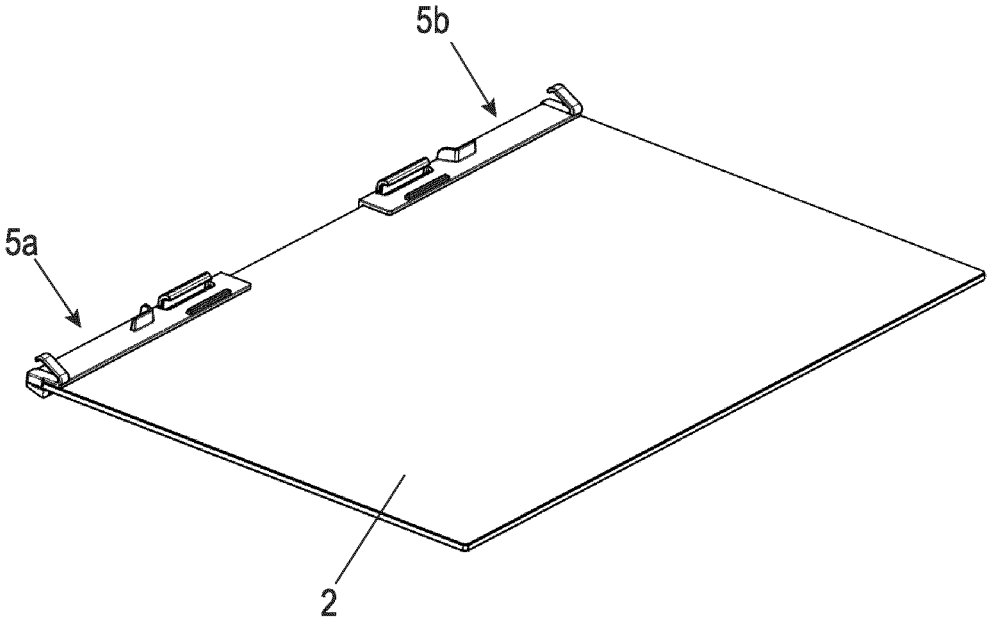
Figure 6B:
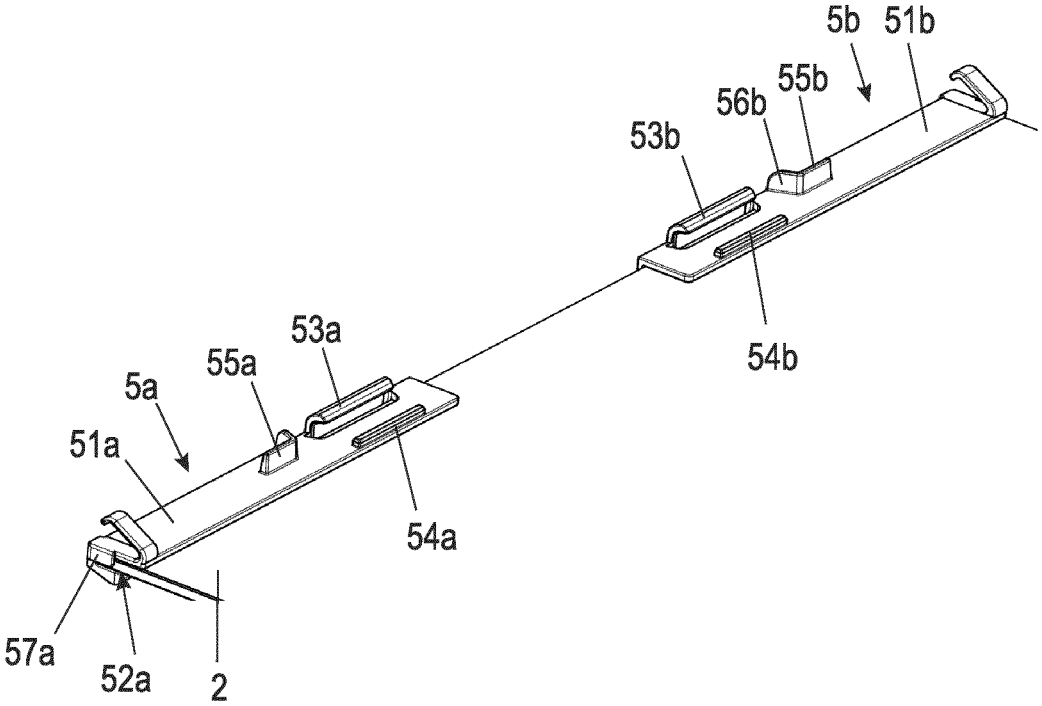
Figure 7A:
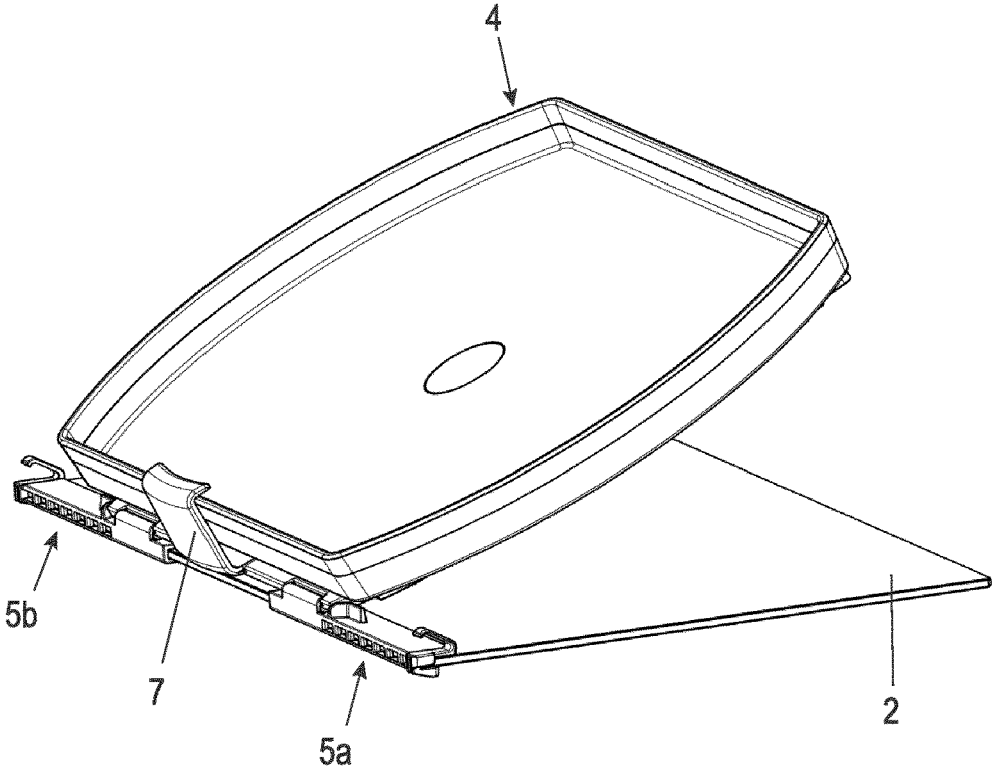
Figure 7B:
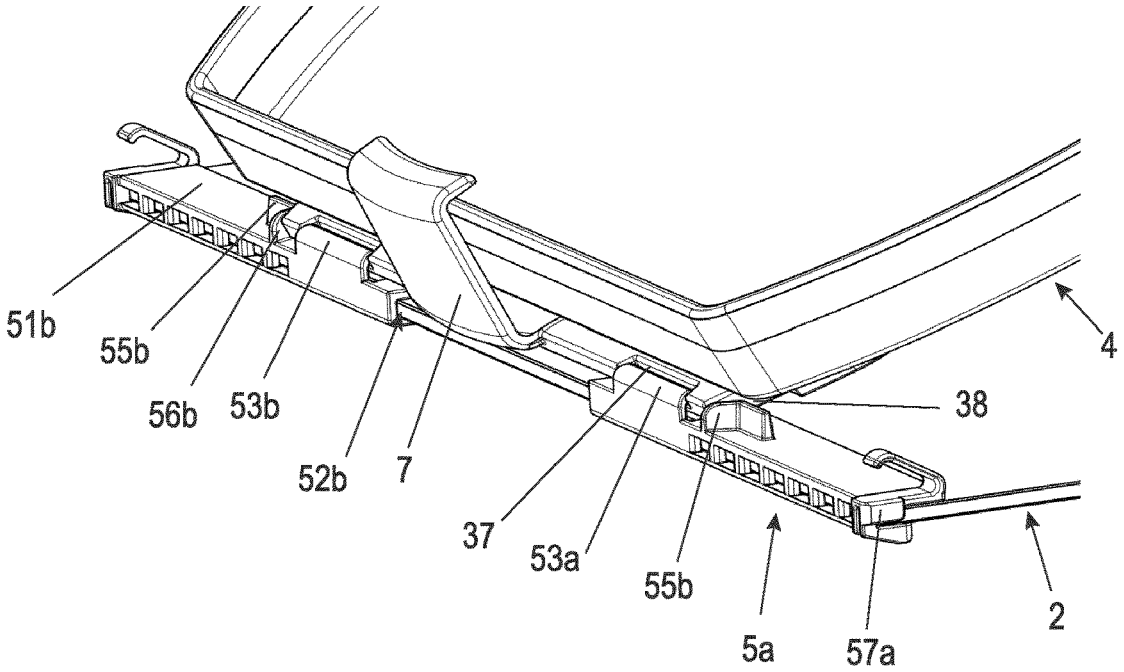
Figure 8A:
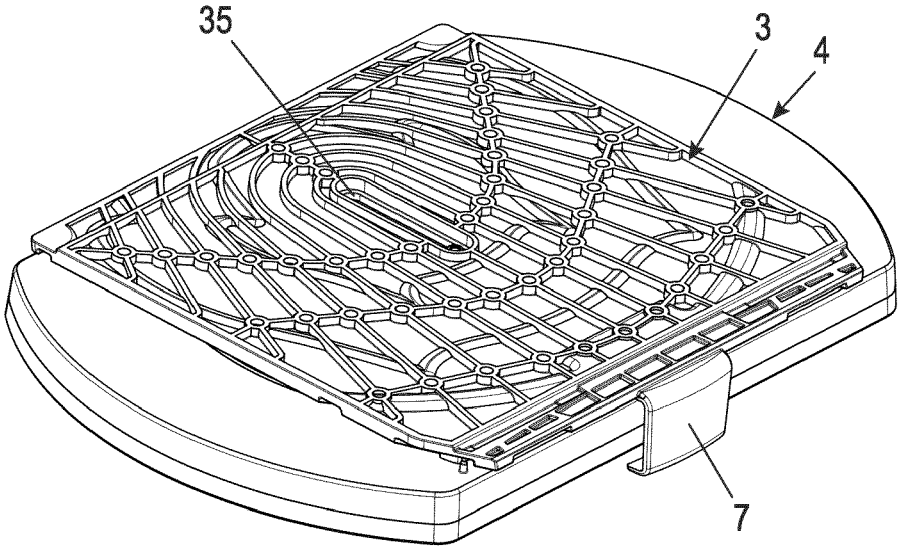
Figure 8B:
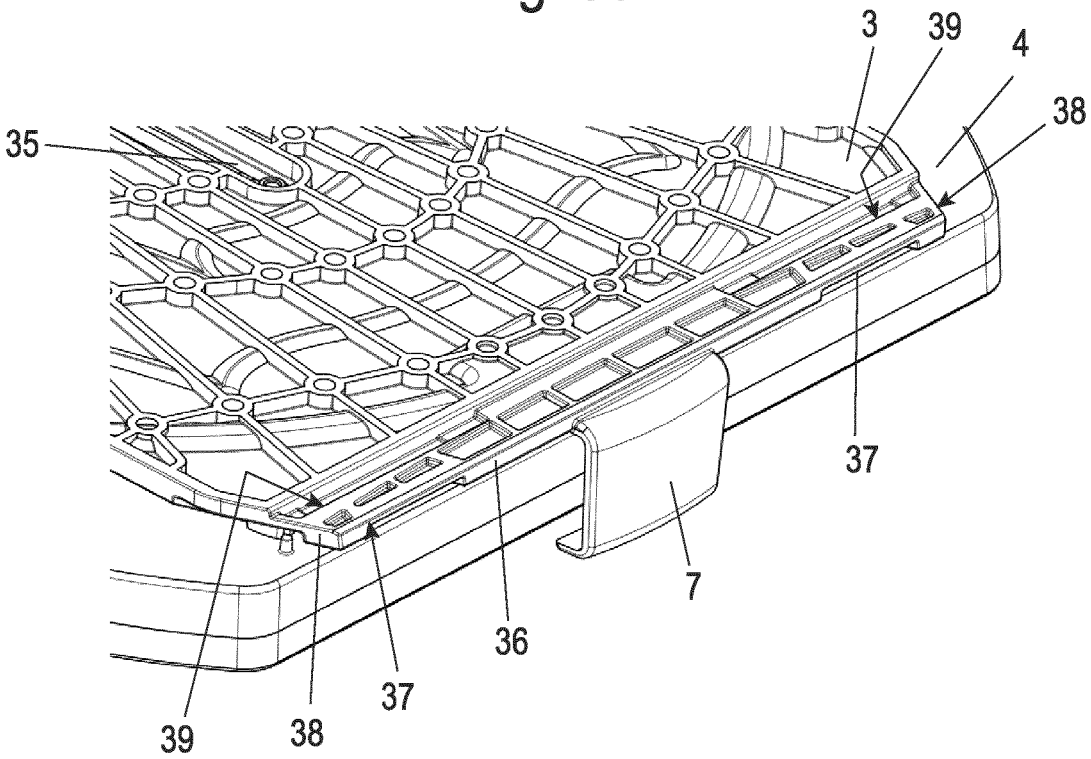
Figure 9A:
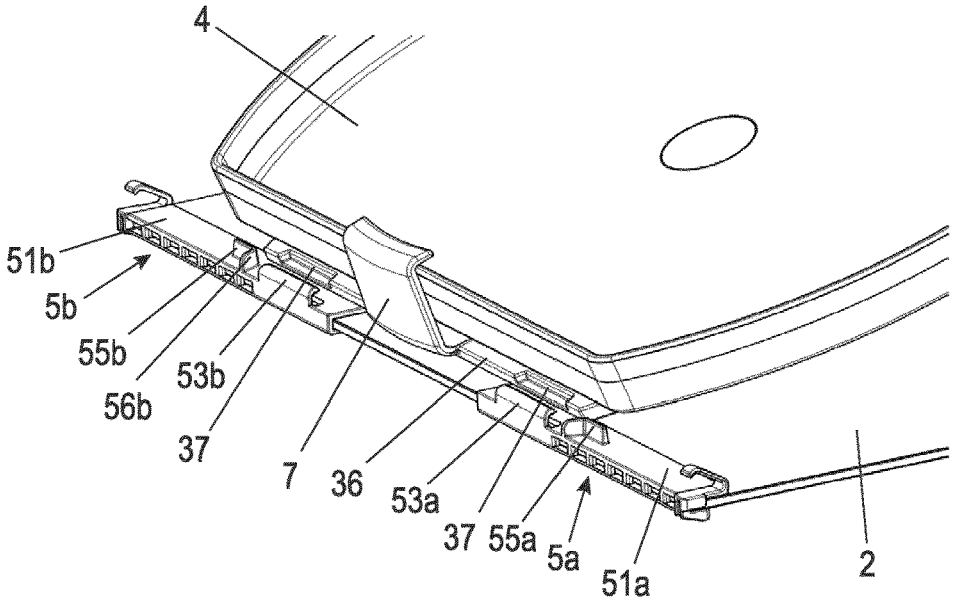
Figure 9B:
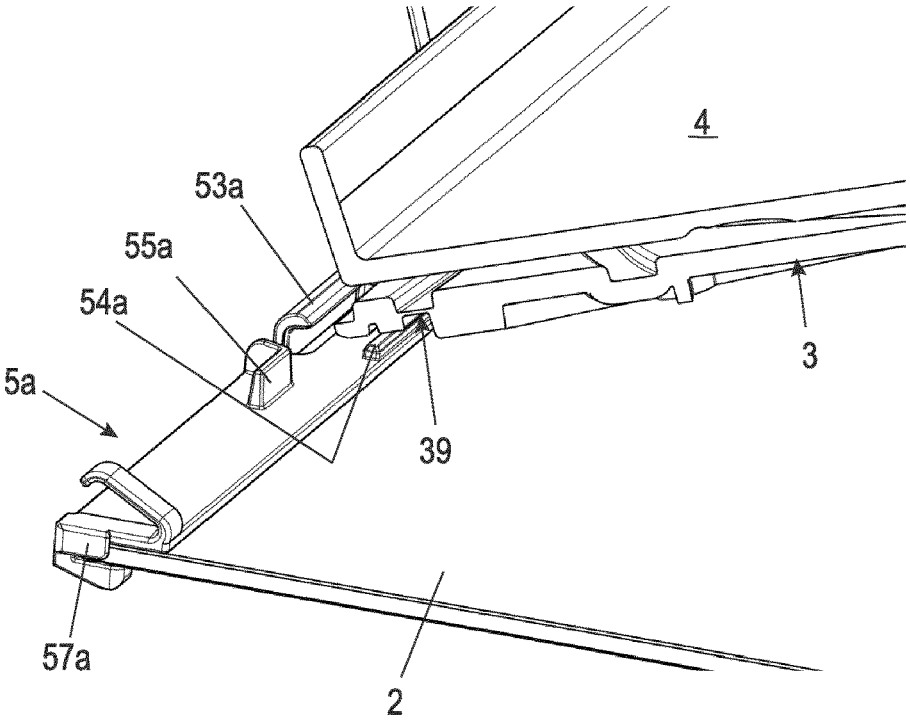
Figure 10:
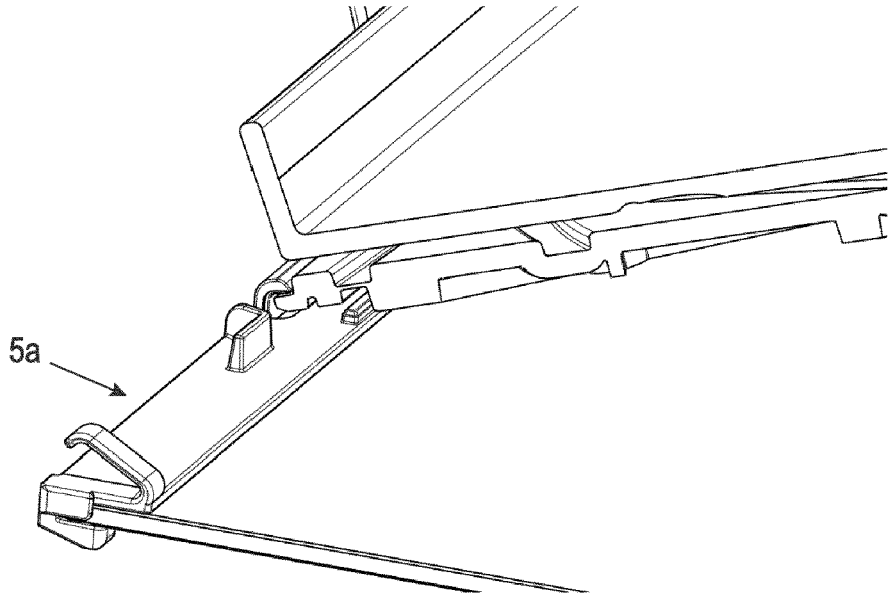
Figure 11:
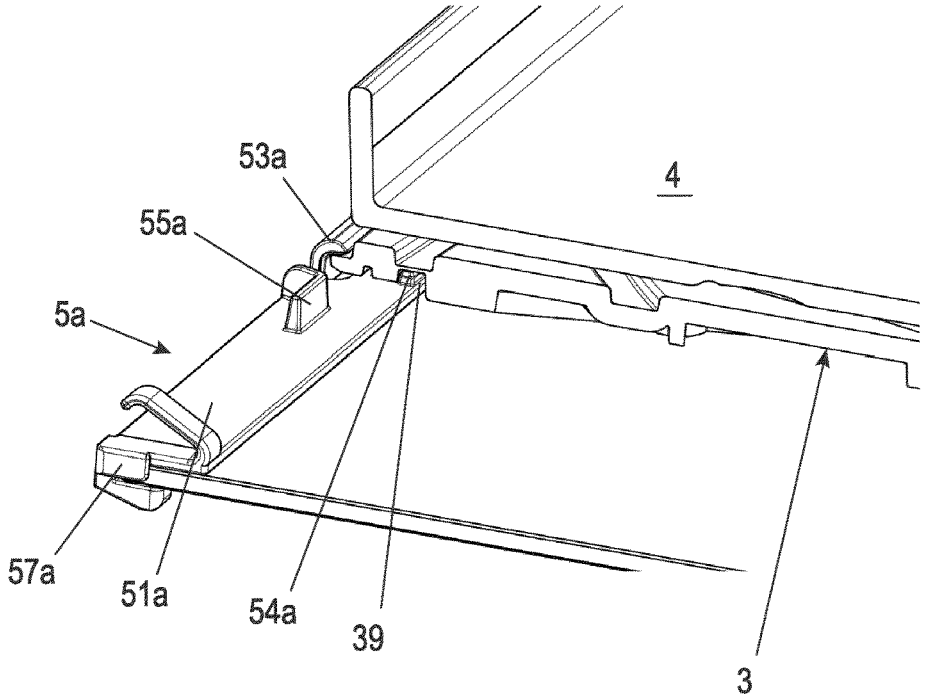
Figure 12:
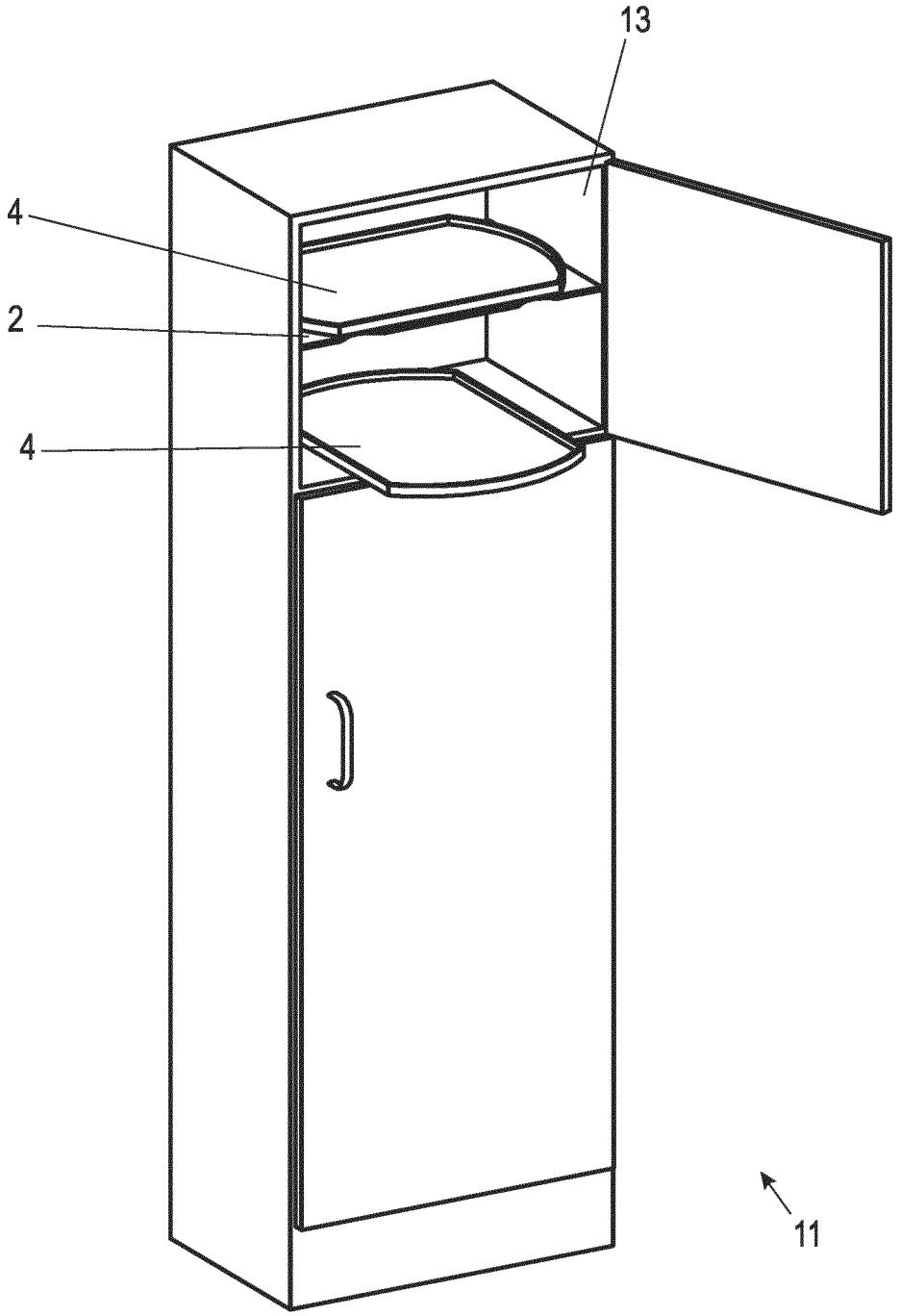
Figure 13:
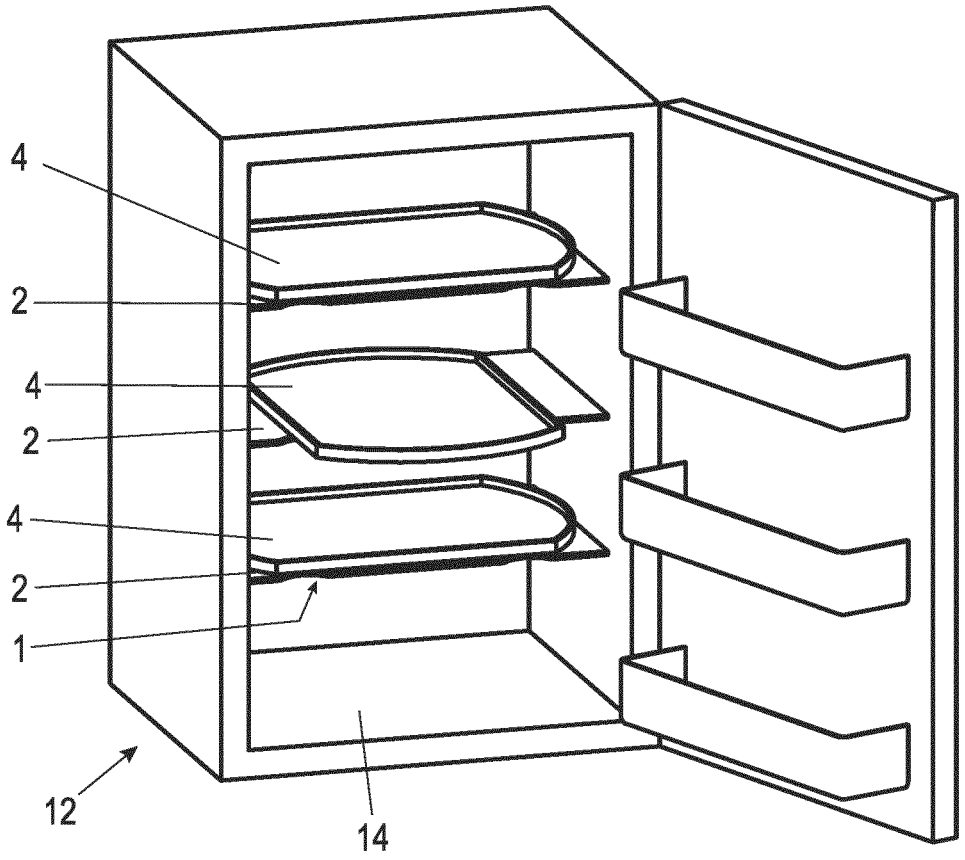

In the following, preferred embodiment examples of the invention are explained in more detail using the enclosed drawings, wherein:

FIG. 1 shows a perspective exploded view of an embodiment variant of a storage shelf base according to the invention, FIG. 2 shows a schematic perspective representation of the storage shelf base as shown in FIG. 1 in a position of the storage shelf rotated by 45° relative to the support plate, FIG. 3 shows a perspective view of the base plate, the support plate and the base plate holder in an exploded view, FIG. 4 shows a sectional view through the storage shelf base according to FIG. 1, FIG. 5 shows a detailed view of the section shown in FIG. 4 for representation of the connection element of the support plate inserted into the recess, FIG. 6*a* shows a perspective view of an alternative embodiment variant of a base plate holder engaging around the rear of the base plate, FIG. 6*b* shows a detailed view of the base plate holder shown in FIG. 6*a*, FIG. 7*a* shows a perspective view of the base plate holder, which engages around the rear side of the base plate, according to FIG. 6*a* with the support plate and storage shelf attached to it, FIG. 7*b* shows a detailed view of the illustration shown in FIG. 7*a*, FIG. 8*a* shows a perspective view of an underside of the support plate with storage shelf, FIG. 8*b* shows a detailed view of a rear area of the support plate which is shown in FIG. 8*a* and coupled to the base plate holder when assembled, FIG. 9*a* shows a perspective view of the base plate holder, which engages around the rear of the base plate, according to FIG. 6*a* before attaching the support plate, FIG. 9*b* shows a detailed view of the position shown in FIG. 9*a*, FIG. 10 shows a perspective view of the base plate holder, which engages around the rear of the base plate, according to FIG. 6*a* after inserting the support plate into the hook elements of the base plate holder before pivoting in, FIG. 11 shows a perspective view of the base plate holder, which engages around the rear of the base plate, according to FIG. 6*a* after inserting the support plate into the hook elements of the base plate holder after pivoting into the functional position, FIG. 12 shows an item of furniture with storage shelf bases according to the invention, FIG. 13 shows a household appliance with storage shelf bases according to the invention.

DETAILED DESCRIPTION

In the following figure description, terms such as top, bottom, left, right, front, back, etc. refer exclusively to the exemplary representation and position of the storage shelf base, the base plate, the support plate, the storage shelf, the base plate holder, the connecting element and the like selected in the respective figures. These terms are not to be understood restrictively, i.e., these references can change due to different working positions or the mirror-symmetrical interpretation or the like.

In FIG. 1, the reference numeral 1 denotes an embodiment variant of a storage shelf base as a whole.

The storage shelf base 1 has a base plate 2, which can be fixed in a stationary manner to a body 13, 14 of an item of furniture 11 or household appliance 12, and a support plate 3 arranged on the base plate 2.

On this support plate 3, there is a storage shelf 4, which can be simultaneously moved in rotation and in translation. For positively guided simultaneous rotational and translational movement, mutually facing bearing surfaces 31, 42 of the support plate 3 and the storage shelf 4 each have at least predominantly closed, circumferential running grooves (33, 34, 43, 44, 45, 46) in which rolling elements 10 are guided. The rolling elements 10 used here are in particular balls.

The support plate 3 is detachably fastened to the base plate 2 or, as shown in FIG. 1, to a base plate holder 5, which fastens the base plate 2 to the body 13, 14 of item of furniture 11 or household appliance 12. The base plate holder 5 is the adapter in this case.

It is also conceivable to fix the support plate 3 or the base plate 2 to the body 13, 14 of the item of furniture 11 or household appliance 12 by means of several such adapters. In the former case, the base plate 2 can also be omitted.

It is also conceivable to detachably fasten the support plate 3 to the base plate 2 using at least one adapter.

As shown in FIGS. 1 and 2, inner running grooves 33, 43, 44 and, for improved support of the storage shelf 4, outer running grooves 34, 45, 46 are provided both on the bearing surface 31 of the support plate 3 facing the storage shelf 4 and on the bearing surface 42 of the storage shelf 4 facing the support plate 3.

The inner running groove 33 of support plate 3 is designed as a closed circumferential running groove. The outer running groove 34 is open towards a front side of storage shelf base 1.

For forced simultaneous rotational and translational movement of storage shelf 4, two partially overlapping inner running grooves 43, 44 and two likewise partially overlapping outer running grooves 45, 46 are each inserted into the bearing surface 42 of storage shelf 4. All running grooves 43, 44, 45, 46 are designed in this case as closed circumferential running grooves.

FIG. 2 shows storage shelf base 1 in a 45° rotated position. As can be seen here, one of the rolling elements 10 is arranged outside the surface of the support plate 3.

To prevent the loss of this rolling element 10, the rolling elements 10 are accommodated in a rolling element cage 9. The rolling element cage 9 here is in the form of a circular ring with four arms extending radially outwards from the circular ring, at each of whose free end a further rolling element 10 is accommodated.

Both the inner running grooves 33, 43, 44 and the outer running grooves 34, 45, 46 are shaped in such a way that, when force is applied to the storage shelf 4 in the horizontal direction, the storage shelf 4 can be moved from a starting point in accordance with the orientation of the storage shelf 4 shown in FIG. 1 relative to the support plate 3 via an intermediate position shown in FIG. 2 into a loading or unloading position rotated by 180°, in which the storage shelf 4 is not only rotated by 180°, but is also displaced by a predetermined distance to facilitate loading and unloading.

The movement back to the starting position takes place in an equally simple manner by exerting force in the horizontal direction in the closing direction, in which the storage shelf 4 is moved further into the closing position while maintaining the initial direction of rotation, or by reversing the direction of rotation.

As shown in FIGS. 1 and 3, the base plate holder 5 engages around an edge 22 of the base plate 2. At the same time, the support plate 3 is also attached to the base plate holder 5.

For this purpose, the base plate holder 5 has two recesses 54, into which a respective connecting element 6 extending from one edge of the support plate 3 can be inserted and which are held in the inserted state in the base plate holder 5 by positive or frictional locking.

As shown in FIGS. 1 and 3, the connecting element 6 is integrally formed on the support plate 3. The connecting element 6 here is designed as a tongue-like web 61, having a hook 62 thickening upwards or bent upwards at its free end, which engages behind a strip section 56 of the base plate holder 5, as shown in FIGS. 4 and 5.

The base plate holder 5 essentially consists of a strip-shaped base body 51 with a slot 52 extending over the longitudinal extension of the base body 51, which serves to accommodate a rear edge 22 of the base plate 2.

Above slot 52, a fastening strip 53 is integrally formed, which serves to fasten the base plate holder 5 to the body of the furniture or household appliance and with which the base plate 2 can be fixed to the body of the furniture or household appliance.

One or more first recesses 54 are introduced into this fastening strip 53 to accommodate the connecting element 6. Alternatively or additionally, there can be recesses on the support plate 3 which interact with corresponding connecting elements on the base plate holder 5, or both the support plate 3 and the base plate holder 5 can be equipped with interacting connecting elements.

An alternative embodiment variant of a base plate holder 5*a*, 5*b* is described below on the basis of FIG. 6*a*-11.

The base plate holder 5*a*, 5*b* in this embodiment variant consists of two separate base plate holders 5*a* and 5*b*, which, like the base plate holder 5 described above, have a respective slot 52*a*, 52*b* to accommodate a rear edge 22 of the base plate 2 and engage around the edge 22 of the base plate 2.

The two base plate holders 5*a*, 5*b* each have a side edge border 57*a* at one side edge, wherein in FIG. 6*b* only the side edge border 57*a* of the base plate holder 5*a* on the left in the figure is shown.

The two base plate holders 5*a*, 5*b* are, as shown in FIGS. 6*a* and 6*b*, mirror symmetrical to each other.

A hook element 53*a*, 53*b* is integrally formed in each case on the upper side of a base body 51*a*, 51*b* of the base plate holders 5*a*, 5*b* facing the support plate 3. The hook element 53*a*, 53*b* in the embodiment variant shown here extends vertically upwards from an area of the base body 51*a*, 51*b* close to the rear edge 22 and is preferably bent forward by about 90°, i.e., towards the center of the upper side 21 of the base plate 2.

As shown in FIG. 5-11, the support plate 3 and the base plate holders 5*a*, 5*b* have positive locking elements by means of which the support plate 3 can be fixed positively to the base plate holder 5*a*, 5*b* by means of a pivoting movement from a position of the support plate 3 set at an angle to the base plate 2 to a position of the support plate 3 resting on the base plate 2.

The hook elements 53*a*, 53*b* engage in recesses 37 on the rear edge 36 of the support plate 3 as shown in FIGS. 7*a*, 7*b*, 9*a*, 9*b*, 10 and 11. These recesses 37 on the rear edge 36 of the support plate 3 are embedded in pocket form from the top of the support plate 3 facing the storage shelf 4 and the rear edge 36.

It is also conceivable to design the recesses 37 as slots and the hook elements 53*a*, 53*b* in such a way that they encompass an angle of more than 90°.

In the embodiment variant shown here, as shown in FIGS. 8*a* and 8*b*, at least one recess 39 is integrally formed in an underside of the support plate 3 facing the base plate 2, near the edge 36 facing the base plate holder 5*a*, 5*b*, into which recess, when the support plate 3 is pivoted onto the support plate 3, a counter strip 54*a*, 54*b* integrally formed on the base plate holder 5*a*, 5*b* protrudes, as shown in FIG. 11.

The counter strips 54*a*, 54*b* are positioned, as shown for example in FIG. 6*b*, in the direction of the translational movement of the storage shelf 4 in front of the hook elements 53*a*, 53*b*, made possible by the slot 35 of the support plate 3.

The recesses 37 at the rear edge 36 of the support plate 3 are preferably dimensioned in width so that they correspond to the width of the hook elements 53*a*, 53*b* and thus also cause a positioning of the support plate 3 perpendicular to the translational movement of the storage shelf 4.

In addition, as shown in FIGS. 6*b*, 7*a* and 7*b*, for the exact alignment of the support plate 3 relative to the base plate 2 on both sides of the rear edge 36 of the support plate 3, the contact surface 38 of the respective side edges of the support plate 3 can, in the pivoted-in state of the support plate 3 on the support plate 3, rest against the respective stop surfaces 56*a*, 56*b* of stops 55*a*, 55*b* protruding from the base plate holder 5*a*, 5*b* towards the support plate 3, as shown in FIGS. 6*b*, 7*a* and 7*b*.

The stops 55*a*, 55*b* are, as shown in FIG. 6*b*, easy to recognize, preferably designed as angle pieces, with a respective stop surface 56*a*, 56*b* for exact positioning of the support plate 3.

FIGS. 9*a*, 9*b*, 10 and 11 show the assembly procedure of the support plate 3 with the storage shelf 4 arranged thereon on the base plate holders 5*a*, 5*b*.

As shown in FIGS. 9*a* and 9*b*, the support plate 3 is first set at an angle to the base plate 2, preferably at an angle of between 30° and 50°, with its rear edge 36, to the hook elements 53*a*, 53*b* and pushed into these. This position is shown in FIG. 10.

The support plate 3 is then pivoted downwards onto the base plate 2 by a pivoting movement. The rear edge 36 of the support plate 3 is embraced by the hook elements 53*a*, 53*b*, which prevents the support plate 3 from moving relative to the base plate 2 in the direction of the translational movement of the storage shelf 4 relative to the support plate 3. The counter strips 54*a*, 54*b* are located in the recess 39 recessed in the underside of the support plate 3, as shown in FIG. 11.

As further shown in FIGS. 1 and 3, the base plate holder 5 has a second recess 55 above the slot 52, which serves to accommodate a tilting protection element 7.

In the embodiment variant shown in FIGS. 6*a* to 11 with two separate base plate holders 5*a* and 5*b*, these are arranged on the side of the tilting protection element 7.

Such a tilting protection element 7 is also arranged on the support plate 3 and shaped in such a way that it engages over an upper edge 48 of the storage shelf 4.

The tilting protection element 7 serves to prevent a tilting movement of the storage shelf 4 around a tilting axis parallel to the shelf surface 41 of the storage shelf 4. Such a tilting movement can occur, in particular, when loads are distributed unevenly on shelf surface 41 of storage shelf 4.

The tilting protection element 7 is preferably designed as a C-shaped catch hook, wherein a section 73 of the tilting protection element 7 protrudes from the rear edge of the support plate 3 and is bent upwards. A flat central section 72 is connected to this section 73, wherein the height extension of which is adapted to the vertical height of a wall surrounding the shelf surface 41 of the storage shelf 4, the upper edge 48 of which projects beyond a bent end 71 of the tilting protection element 7 adjoining the central section 72 and, in the event of a tilting movement, prevents the storage shelf 4 from tilting.

It is also conceivable to arrange retaining elements on the support plate 3 itself, in particular to form them around the base plate 2 and thus allow the support plate 3 to be fixed to the base plate 2.

The support plate 3 and the storage shelf 4 are fixed to each other for axial fixing by means of a fixing device 8.

As shown in FIG. 1, the fixing device 8 has a screw 81 protruding from below through a slot 35 in the support plate 3, thus enabling a displacement movement of the storage shelf 4 relative to the support plate 3.

In order to enable a low-friction displacement movement, a washer 82 and a sliding ring 83 are placed on screw 81, which is in contact with the underside of the support plate 3 facing the base plate 2 in the area of slot 35.

For axial fixing with the storage shelf 4, a mounting receptacle 47 is inserted in the shelf surface 41 of the storage shelf 4, which is covered by a cap 84.

The underside of this cap 84 facing screw 81 is provided with a screw hole with an internal thread into which screw 81 can be screwed, thus holding the cap 84 axially in its mounting position.

The base plate 2 can be designed as a glass plate. It is also possible to design a base plate 2 as a wooden plate or a plate made of plastic or metal. The support plate 3 and the storage shelf 4 are preferably made of plastic or glass.

It is particularly advantageous that, for example, in the case of a household appliance designed as a refrigerating device, such as in particular a refrigerator or freezer, an already existing base plate 2, for example in the form of a glass plate, can be used to stabilize and retrofit the support plate and the storage shelf to create a storage shelf base 1, which can be moved simultaneously by translation and rotation and is therefore particularly easy to load or unload.

FIG. 12 shows the storage shelf bases according to the invention in an item of furniture 11, wherein the item of furniture 11 has a body 13 in which the storage shelf bases 1 are arranged.

FIG. 13 shows storage shelf bases according to the invention in a household appliance 12, in this case a cooling appliance, wherein the household appliance 12 has a body 14 in which the storage shelf bases 1 are arranged.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 Storage shelf base
2 Base plate
22 Edge
3 Support plate
31 Bearing surface
33 Running groove
34 Running groove
35 Slot
36 Rear edge
37 Recess
38 Contact surface
39 Groove
4 Storage shelf
42 Bearing surface
41 Shelf surface
43 Running groove
44 Running groove
45 Running groove
46 Running groove
47 Mounting receptacle
48 Upper edge
5 Base plate holder
51 Base body
52 Slot
53 Fastening strip
54 First recess
55 Second recess
56 Strip section
**5*a*** Base plate holder
**51*a*** Base body
**53*a*** Slot
**53*a*** Hook element
**54*a*** Counter strip
**55*a*** Stop
**56*a*** Stop surface
**57*a*** Edge border
**5*b*** Base plate holder
**51*b*** Base body
**52*b*** Slot
**53*b*** Hook element
**54*b*** Counter strip
**55*b*** Stop
**56*b*** Stop surface
6 Connecting element
61 Web
62 Hook
7 Tilting protection element
71 Bent end
72 Central section
73 Section
8 Fixing device
81 Screw
82 Washer
83 Sliding ring
84 Cap
9 Rolling element cage
10 Rolling elements

11 Item of furniture
12 Household appliance
13 Body
14 Body

The invention claimed is:

1. A storage shelf base for an item of furniture or household appliance, the storage shelf base comprising:

a support plate arranged in a stationary manner on a body of the item of furniture or household appliance;

a storage shelf configured to be positively guided relative to the support plate and configured to simultaneously move rotatably and translationally, wherein mutually facing bearing surfaces of the support plate and of the storage shelf have respective at least predominantly closed, circumferential running grooves in which rolling elements are guided, wherein the support plate is detachably fastened to the body of the item of furniture or household appliance by at least one adapter, or a base plate is arranged in a stationary manner on the body of the item of furniture or household appliance, and the support plate is detachably fastened to the base plate, wherein the base plate is arranged in a stationary manner on the body of the item of furniture or household appliance and the at least one adapter is a base plate holder fixing the base plate to the body of the item of furniture or household appliance, and wherein the base plate holder at least partially engages around an edge of the base plate and has at least one first recess in which a connecting element extending from an edge of the support plate is inserted, wherein the inserted connecting element is held in the base plate holder in a form-fitting or frictionally engaged manner.

2. The storage shelf base of claim 1, wherein the connecting element is integrally formed on the support plate.

3. The storage shelf base of claim 1, wherein the connecting element has a hook that engages behind a strip section of the base plate holder.

4. The storage shelf base of claim 1, wherein the support plate is detachably fastened to the base plate by the at least one adapter.

5. The storage shelf base of claim 1, wherein the support plate has retaining elements that engage around the base plate.

6. The storage shelf base of claim 5, wherein the retaining elements are integrally formed on the support plate.

7. A storage shelf base for an item of furniture or household appliance, the storage shelf base comprising:

a support plate arranged in a stationary manner on a body of the item of furniture or household appliance;

a storage shelf configured to be positively guided relative to the support plate and configured to simultaneously move rotatably and translationally, wherein mutually facing bearing surfaces of the support plate and of the storage shelf have respective at least predominantly closed, circumferential running grooves in which rolling elements are guided, wherein the support plate is detachably fastened to the body of the item of furniture or household appliance by at least one adapter, or a base plate is arranged in a stationary manner on the body of the item of furniture or household appliance, and the support plate is detachably fastened to the base plate, wherein the base plate is arranged in a stationary manner on the body of the item of furniture or household appliance and the at least one adapter is a base plate holder fixing the base plate to the body of the item of furniture or household appliance, wherein the base plate holder at least partially engages around an edge of the base plate, the support plate and the base plate holder have form-fit elements, via which the support plate is positively fixed to the base plate holder by a pivoting movement from a position of the support plate set at an angle to the base plate into a position of the support plate resting on the base plate.

8. The storage shelf base of claim 7, wherein recesses are integrally formed on a rear edge of the support plate facing the base plate holder, a hook element engages into each of the recesses, and the hook element is integrally formed on the base plate holder.

9. The storage shelf base of claim 8, wherein at least one recess is integrally formed in an underside of the support plate facing the base plate near the rear edge facing the base plate holder, a counter strip integrally formed on the base plate holder projects into the at least one recess when the support plate is pivoted onto the support plate.

10. The storage shelf base of claim 8, wherein bearing surfaces of respective side edges of the support plate rest close to the rear edge of the support plate against respective stop surfaces of stops projecting from the base plate holder towards the support plate.

11. A storage shelf base for an item of furniture or household appliance, the storage shelf base comprising:

a support plate arranged in a stationary manner on a body of the item of furniture or household appliance;

a storage shelf configured to be positively guided relative to the support plate and configured to simultaneously move rotatably and translationally, wherein mutually facing bearing surfaces of the support plate and of the storage shelf have respective at least predominantly closed, circumferential running grooves in which rolling elements are guided, wherein the support plate is detachably fastened to the body of the item of furniture or household appliance by at least one adapter, or a base plate is arranged in a stationary manner on the body of the item of furniture or household appliance, and the support plate is detachably fastened to the base plate, a tilting protection element, which engages over an upper edge of the shelf or engages in a groove of the shelf, wherein the tilting protection element is arranged on the support plate to prevent a tilting movement of the storage shelf about a tilting axis parallel to the shelf surface of the storage shelf.

12. The storage shelf base of claim 11, wherein the at least one adapter is a base plate holder fixing the base plate to the body of the item of furniture or household appliance, the base plate holder at least partially engages around an edge of the base plate and has at least one first recess in which a connecting element extending from an edge of the support plate is inserted, wherein the inserted connecting element is held in the base plate holder in a form-fitting or frictionally engaged manner, and wherein a section of the tilt protection element is inserted in a second recess of the base plate holder.

13. The storage shelf base of claim 11, wherein the tilting protection element is a catch hook.

* * * * *